United States Patent [19]

Panovic

[11] Patent Number: 4,533,116

[45] Date of Patent: Aug. 6, 1985

[54] CLAW HAMMER FOR DRIVING AND EXTRACTING NAILS

[75] Inventor: Vlatko Panovic, Vancouver, Canada

[73] Assignee: Drexore Resources Inc., Vancouver, Canada

[21] Appl. No.: 510,624

[22] Filed: Jul. 5, 1983

[51] Int. Cl.[3] ..... B66F 15/00

[52] U.S. Cl. ..... 254/26 R

[58] Field of Search ..... 254/26 R, 26 E, 27; 145/29 R

[56] References Cited

U.S. PATENT DOCUMENTS

| | | | |
|---|---|---|---|
| 623,455 | 4/1899 | Yonge | 254/27 |
| 807,643 | 12/1905 | Sly | 254/26 R |
| 866,931 | 9/1907 | Higgins | 254/26 R |
| 900,338 | 10/1908 | Wolfe . | |
| 1,110,188 | 9/1914 | Currie | 254/26 R |
| 1,422,262 | 7/1922 | Hansen | 254/26 R |
| 1,580,913 | 4/1926 | McLain | 254/27 |
| 1,664,594 | 4/1928 | Cummings . | |
| 1,725,416 | 8/1929 | Pfister | 254/26 R |
| 1,773,931 | 8/1930 | Ayvad | 254/26 R |
| 1,792,437 | 2/1931 | Metzger et al. | 254/26 R |
| 1,934,706 | 11/1933 | Green | 254/26 R |
| 2,231,206 | 2/1941 | Anderson | 254/26 E |

FOREIGN PATENT DOCUMENTS 483540 5/1952 Canada .

*Primary Examiner*—Robert C. Watson

*Attorney, Agent, or Firm*—Carver & Co.

[57] ABSTRACT

A claw hammer head has a fulcrum member hinged by a hinge assembly to the head for swinging between retracted and extended positions. In the retracted position, the fulcrum member is retained in a recess in the head so that the hammer can be used for driving nails into a work surface in the normal manner. In the extended position, the fulcrum member is swung relative to the head to extend beyond the head so as to increase leverage for extracting nails from the surface. The fulcrum member is hinged to the head in such a manner that load incurred while extracting nails is transferred essentially directly to a bearing surface of the hammer head, and thus relieves load from the hinge assembly. The fulcrum member has a periphery that contacts the work surface in the extended position, the periphery having a relatively large radius of curvature for initially extracting the nail, and then rolls onto a smaller radius of curvature when the nail is partially removed from the surface, thus relieving the work surface of high initial loading, and reducing damage to the surface.

15 Claims, 9 Drawing Figures

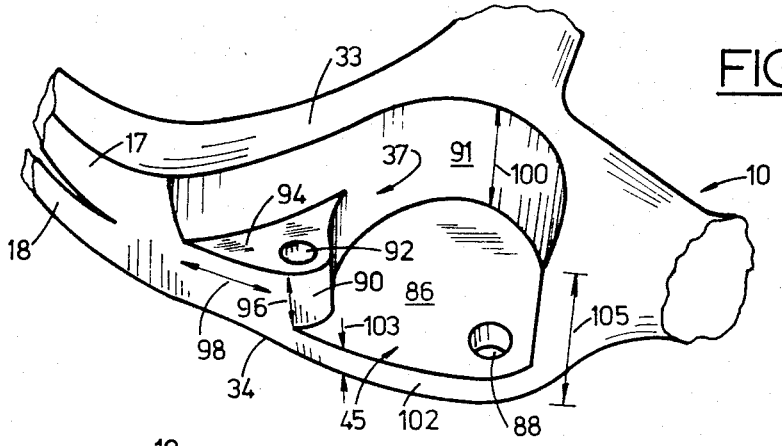
FIG 5
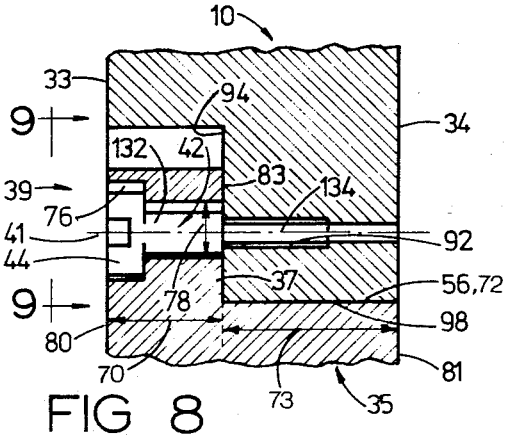
FIG 8
FIG 9
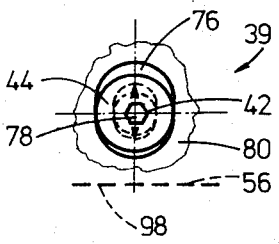
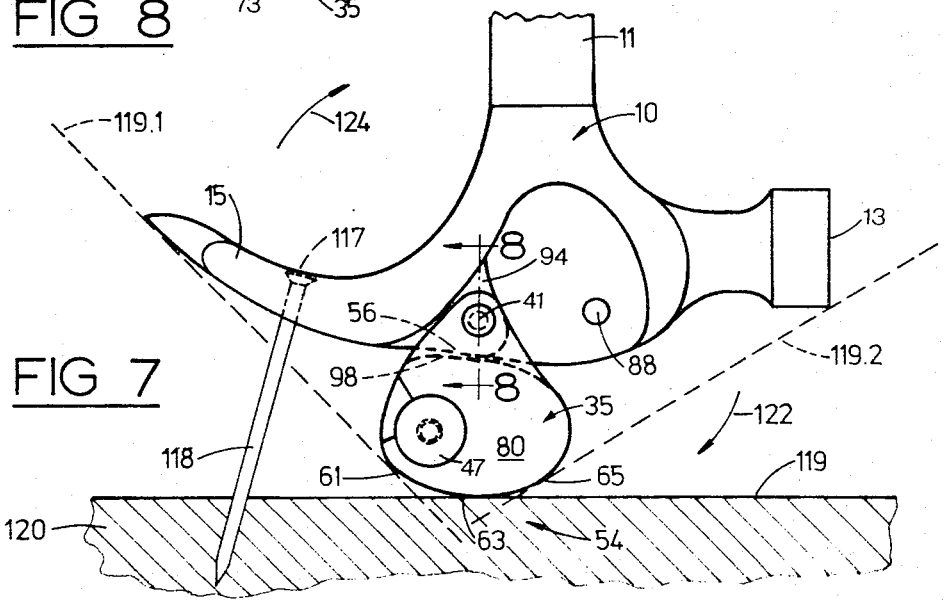
FIG 7

CLAW HAMMER FOR DRIVING AND EXTRACTING NAILS

BACKGROUND OF THE INVENTION

1. Field of the Invention

The invention relates to a hammer head adapted to be fixed to a hammer shaft, in particular a hammer head fitted with a claw for extracting nails from a work surface.

2. Prior Art

Claw hammers have been used for many years for extracting nails from a work surface. A claw hammer is particularly useful for removing nails from the work surface, because the hammer shaft provides leverage and thus a mechanical advantage which helps in overcoming resistance of the nail to being pulled from the surface. Difficulty can be experienced with a common claw hammer in extracting heavy long nails which have been driven so that the nail head thereof is flush with the work surface. This difficulty can be overcome by using a separate specialised nail puller with thin claws. Often long nails are bent when being extracted with a common claw hammer or nail puller.

Various devices have been invented to increase mechanical advantage of a claw hammer for extracting heavy long nails, and many of these devices relate to an adjustable fulcrum member or equivalent which increases mechanical advantage to facilitate extraction of such nails. Some of these adjustable fulcrums are hinged to the hammer head, and typical examples are found in U.S. Pat. No. 623,455 (Yonge); U.S. Pat. No. 2,231,206 (Anderson) and 2,657,903 (Johnson). While devices in some of these patents may be adequate for removing short or light nails, the fulcrum members of such patents are relatively weak when compared to the forces encountered in extracting long heavy nails, and such devices would likely fail under heavy usage. Many of the prior art devices use a relatively light flanged fulcrum member which is hinged to the hammer head by a relatively light pin. During extraction, extraction forces are transferred through the fulcrum member usually to the pin and through a relatively small bearing areas between the fulcrum member and the head. The pin and relatively small bearing areas are subjected to high bearing pressures, which result in rapid breakdown or wear of the surfaces, commonly with resulting premature failure of the device. Also, such fulcrum members commonly have an edge or corner which can be forced into the working surface during extraction, which edge results in high bearing forces applied to the work surface, causing indentation or other damage to the work surface.

Other nail extraction devices utilize longitudinally extending adjustable fulcrum members, typical devices being shown in U.S. Pat. No. 524,539 (Burgess); U.S. Pat. No. 1,067,729 (Frey) and U.S. Pat. No. 2,741,456 (Williams). The fulcrum member of each of these three patents extend from the hammer head outwardly in the direction of the hammer shaft, and have edges which would tend to be forced into the work surface during initial extraction of the nail, thus damaging the surface. Furthermore, the longitudinally extending fulcrum member is subjected to considerable lateral loads during initial extraction and likely would bend or wear excessively when subjected to heavy use.

Also, some of the fulcrum devices which are either hinged to the hammer head, or fitted for axial sliding movement relative the head, have a tendency to accidentally extend from the head during normal hammering. Also, some devices extend around side portions of the head and thus interfere with normal use of the hammer, and can prevent exceptional use of the hammer such as striking nails with the side of the hammer head which is sometimes required when driving nails in restricted spaces.

SUMMARY OF THE INVENTION

The present invention reduces difficulties and disadvantages of the prior art by providing a hammer head in which a fulcrum member is hinged to the hammer head in such a manner that forces incurred during extraction of a nail from the work surface are transferred essentially directly to the hammer head, thus relieving the hinge assembly of excessive forces during extraction, and thus reducing a tendency of the device to fail prematurely. Also, when the hammer head is to be used for normal hammering, the fulcrum member is retracted into a recess in the head to permit normal use of the hammer without interference or a tendency for the fulcrum member to accidently move from the retracted position. Also, the fulcrum member has a periphery having a relatively large radius of curvature to contact the work surface during initial extraction of the nail, thus reducing the bearing load on the work surface. The reduced bearing load reduces penetration of the fulcrum member into the work surface, thus reducing or substantially eliminating damage to the work surface. Furthermore, the penetrating means has a relatively wide width, further reducing damage to the work surface. Also, nails extracted when using the present invention correctly can be extracted with negligible bending of the nails.

A hammer head according to the invention is adapted to be fixed to a hammer shaft, the head having a face for striking a nail for driving the nail into a work surface, and a claw device at an opposite end for extracting the nail from the work surface. The head is characterised by a fulcrum member, a load relieving means, a recess and a retaining means. The fulcrum member has an inner portion hinged to the head by a hinge assembly for rotation between extended and retracted positions. The hinge assembly has a hinge axis disposed normally to the hammer shaft and normally to a head axis extending between ends of the hammer head. The load relieving means is characterized by the fulcrum member having a fulcrum member bearing surface and the hammer head having a head bearing surface. The two bearing surfaces are adapted to contact each other when the fulcrum member is in the extended position so that a contact area between the bearing surfaces is disposed between the hinge pin and an outer periphery of the fulcrum member which is in contact with the work surface. This permits transfer of load between the bearing surfaces, and relieves load from the hinge assembly when extracting nails. The head has the recess to receive the fulcrum member in the retracted position, and the retaining means cooperate with the fulcrum member and the hammer head to retain the fulcrum member in the retracted position while hammering.

A detailed disclosure following, related to drawings, describes a preferred embodiment of the invention, which is capable of expression in structure other than that particularly described and illustrated.

DESCRIPTION OF THE DRAWING

FIG. 7 is a simplified fragmented side elevation of the hammer head shown with the fulcrum member in an extended position, and extracting a nail from a work surface, FIG. 8 is a simplified fragmented section as would be seen from line 8—8 of FIG. 7, FIG. 9 is a simplified side elevation as would seen from line 9—9 of FIG. 8.

DETAILED DISCLOSURE

Figure 1:
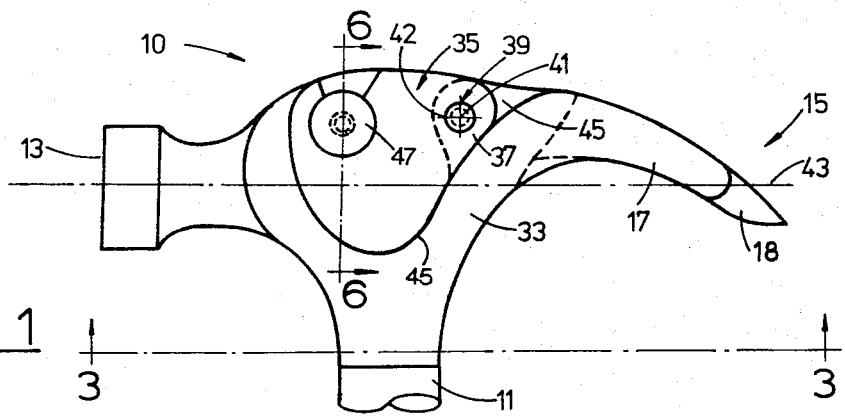
FIG. 1 is a simplified fragmented side elevation of the hammer head according the invention, fitted with a fulcrum member according to the invention, the fulcrum member shown in a retracted position.
Figure 2:
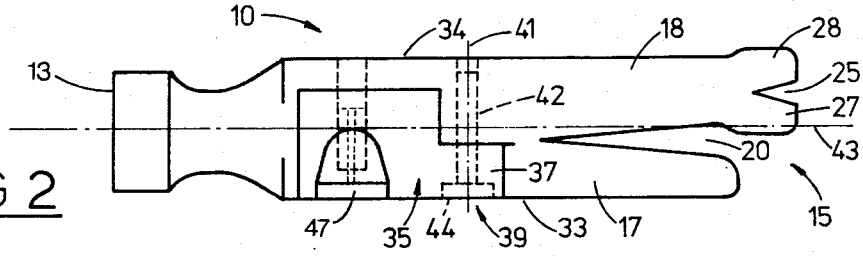
FIG. 2 is a simplified top plan view of the head of FIG. 1.
Figure 3:
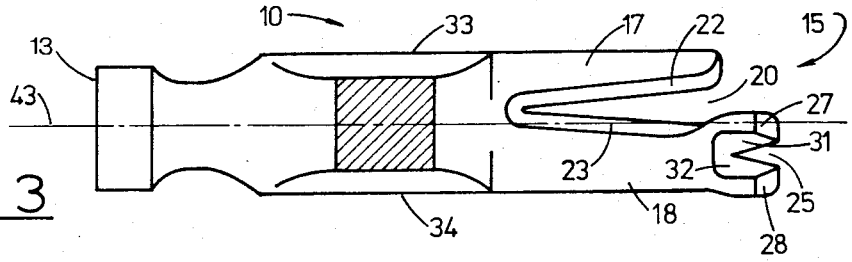
FIG. 3 is a simplified transverse section on line 3—3 of FIG. 1.

FIGS. 1 through 3

A hammer head 10 according to the invention is shown fitted to a hammer shaft 11 in a relatively conventional manner. The head 10 has a face 13 for striking a nail for driving the nail into a work surface, both of which are shown in FIG. 7. The head also has a claw device 15 at an opposite end for extracting the nail from the work surface. The claw device has a pair of spaced claw fingers 17 and 18 which define a tapered recess 20 therebetween. The fingers 17 and 18 have bevelled edges 22 and 23 respectively to facilitate positioning of the fingers under the head of the nail. The finger 18 has an outer end having a second tapered recess 25 defined by thinner claw fingers 27 and 28 having inwardly facing bevelled edges 31 and 32 respectively. The recess 25 is for extracting smaller nails than could be extracted using the larger recess 20, or also for initiating extraction of a large nail that is recessed into the work surface and is particularly difficult to extract. As can be seen, the claw finger 18 having the recess 25 extends further from the shaft 11 than the remaining claw finger 17, to ensure that the finger 17 does not interfere with the work surface during nail extraction. To initiate extraction of such a nail, the recess 25 is positioned to engage the nail, and the head 13 is stuck with a second hammer. By providing the thinner fingers combined with the claw device, the need for a separate conventional nail puller bar with a thinner claw can be eliminated. The hammer head has first and second side faces 33 and 34, the face 34 being unaffected by the invention and thus is available for striking nails as is sometimes required when working in confined spaces.

The invention relates to a means for increasing leverage, and thus mechanical advantage, when extracting nails. A fulcrum member 35 according to the invention has an inner portion 37 hinged to the head by a hinge assembly 39. The hinge assembly has a hinge axis 41 disposed normally to the hammer shaft 11 and normally to a head axis 43 extending between ends of the hammer head having the face and claw device. The hinge assembly includes a cylindrical hinge pin 42 fixed to the head so as to be nonrotationally mounted therein and is disposed to be concentric with the hinge axis 41. The hinge pin can be a toughened steel threaded shaft or bolt having a flat head 44 recessed into the inner portion 37 of the fulcrum member. The side face 33 of the head has a recess 45 to receive the fulcrum member in a retracted position as shown, the particular shapes of the fulcrum member and recess to be described with reference to FIGS. 4 and 5 respectively. A plunger member 47 is resiliently mounted in the fulcrum member to retain the fulcrum member in the retracted position as shown and is described in greater detail with reference to FIG. 6.

Figure 4:
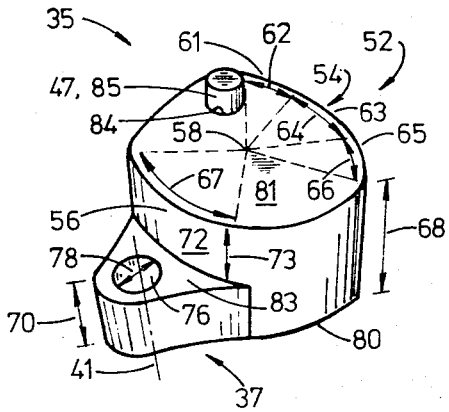
FIG. 4 is a simplified perspective of the fulcrum member shown removed from the head, a portion of the hinge assembly being shown, FIG. 5, which appears on sheet 2 of the drawings, is a simplified fragmented perspective of a portion of the hammer head showing a recess to receive the fulcrum member, and portions of the hinge assembly thereof.
Figure 6:
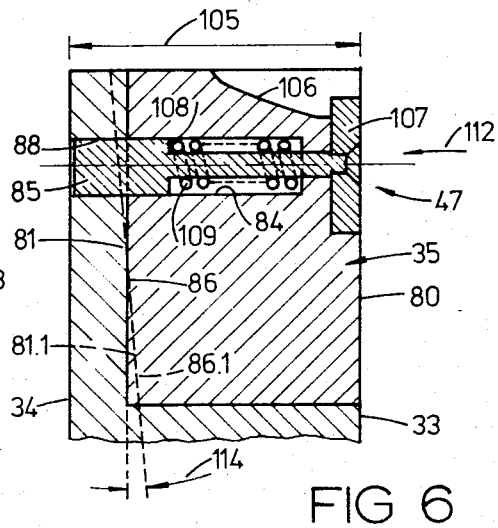
FIG. 6 is a simplified fragmented section as would been seen from line 6—6 of FIG. 1.

FIGS. 4 through 6

Referring mainly to FIG. 4, the fulcrum member 35 has an outer portion 52 disposed at end of the fulcrum member generally opposite to the inner portion 37. The outer portion 52 has an outer periphery 54 which is adapted to contact the work surface containing the nail when the fulcrum member is in the extended position as shown in FIG. 7. The outer portion has an inner periphery 56 which provides a bearing surface adapted to contact the hammer head as will be described. For convenience of discussion, the fulcrum member 35 is assumed to have a theoretical centre 58 towards which portions of the inner and outer peripheries subtend angles as will be described. The outer periphery 54 has a partially cylindrical surface that includes a first portion 61 which is defined by an arc 62, a second portion 63 defined by an arc 64 and a third portion 65 defined by an arc 66. As will be described, the first portion has a relatively large radius of curvature and the second and third portions have correspondingly smaller radii of curvature. The inner periphery 56 is defined by an arc 67 which is complementary to a portion of the head as will be described. The outer portion has a width 68 as measured parallel to the hinge axis 41, and the inner portion 37 has a width 70. The width 68 is greater than the width 70 to provide a shoulder 72 having a width 73 equal to difference in width between the inner and outer portions. The arc 67 defines a bearing portion or shoulder to provide a fulcrum member bearing surface as will be described.

The inner portion 37 of the fulcrum member has an opening 76 to receive the hinge pin 42, FIG. 1, the opening being noncircular and adapted to provide a hinge bearing with lost motion. The opening 76 has a maximum width greater than diameter of the pin 42 and is defined by an axis 78 which is disposed generally normally to the inner periphery 56 for reasons as will be described with reference to FIG. 8. The fulcrum member has outer and inner generally flat parallel faces 80 and 81 respectively, space between the faces defining the width 68. The inner portion 37 has an outer face coplanar with the outer face 80, and an inner face 83 parallel to the outer face and spaced therefrom at the width 70. The plunger member 47 has an inner portion 85 which is mounted in a plunger bore 84 of the fulcrum member and is shown projecting inwardly from the inner face of 81 and is described in great detail with reference to FIG. 6.

Referring mainly to FIGS. 5 and 6, the recess 45 of the head 10 is generally complementary to the fulcrum member 37. The recess 45 has a main face 86 adapted to be adjacent to the inner face 81 of the fulcrum member when the fulcrum member is in the retracted position. The main face has a plunger recess 88 to receive the inner portion 85 of the plunger member 47 so as to hold the fulcrum member in the retracted position, as best seen in FIG. 6. The hinge assembly 37 includes a hinge boss 90 extending from a wall 91 of the recess and having a threaded bore 92 so as to accept an inner end of the hinge pin so as to fix the pin to the head as seen in FIG. 8. The hinge boss has a boss face 94 which is generally parallel to the face 86 and is spaced therefrom by a spacing 96 which is approximately equal to the width 73 of the shoulder 72 of FIG. 4. The hammer head has a head bearing surface 98 which is a portion of the head adjacent to the recess and is positioned between the boss face 94 and the second side face 34 of the hammer. The head bearing surface 98 is generally complementary to the fulcrum member bearing surface 56, the two bearing surfaces being adapted to contact each other when the fulcrum member is in the extended position as shown in FIG. 7. The width 68 of the fulcrum member, FIG. 4, is approximately equal to depth 100 of the wall 91, so that the outer face 80 of the fulcrum member is generally flush with the first side face 33 of the hammer head. A connecting wall 102 extending between the inner face 86 and the second side face 34 has a thickness 103 which is sufficiently strong to permit the hammer to function as a conventional hammer, and yet is not excessively wide as to result in a fulcrum member having an overall width 68 much less than thickness 105 the head of the hammer, that is a spacing between the side faces 33 and 34. Thus the outer portion of the fulcrum member has a periphery having a width which approximates to width of the hammer head as measured parallel to the hinge axis.

Referring specifically to FIG. 6, the plunger member 47 has an outer portion 107 adjacent to a relieved portion 106 of the face 80 of the fulcrum member remote from the inner face 81, the outer portion being adapted to be gripped by an operator to move the plunger member axially outwardly from the fulcrum member. A compression coil spring 109 extends between an end of the plunger bore 84 in the fulcrum member and a shoulder 108 of the inner portion 85 of the plunger member. Thus the plunger member is forced outwardly in the direction of the arrow 112 so as to engage the recess 88 in the main face 86. The force in the spring can be overcome by an operator who can withdraw the inner end of the plunger member from the plunger recess to permit the fulcrum member to attain the extended position as shown in FIG. 7. Thus the plunger member is resiliently mounted within the bore of the fulcrum member for movement generally parallel to the hinge axis, not shown, wherein the inner portion of the plunger member projects inwardly from the inner face 81 of the fulcrum member.

FIGS. 7 through 9

In FIG. 7, a nail 118 having a head 117 is shown extending from a work surface 119 of a piece of wood 120. The hammer head 10 is shown with the fulcrum member 35 positioned in the extended position, which is attained by swinging the fulcrum member from the retracted position about the axis 41 in direction of an arrow 122. In this position the inner periphery or bearing surface 56 is shown in contact with the head bearing surface 98, both of which are shown as a common broken line in FIG. 7, and more clearly in section in FIG. 8. The outer periphery 54 of the fulcrum member contacts the surface 119, and the second portion 63, having the intermediate radius of curvature, is shown rolling along the surface 119 as the hammer head rotates about the fulcrum member in direction of an arrow 124.

The hammer is shown in an approximate mid position of swing where the nail is partially withdrawn an amount sufficient to permit the claw device 15 to be inserted under the nail head with the fulcrum member extended. The hammer head can swing between two extreme positions in which the surface 119 has corresponding extreme relative positions shown as broken lines 119.1 and 119.2.

The hinge assembly 39 will now be described in greater detail with reference to FIGS. 8 and 9. The hinge pin 42 has the flat head 44, a generally cylindrical shank 132, and a threaded inner end 134 which is secured in the threaded bore 92 of the hammer head 10. The opening 76 of the fulcrum member 35 is counter bored at the outer end to receive the flat head 44 and the remaining portion of the bore 76 is non-circular or oval sectioned to provide lost motion between the pin and bore 76 so that the maximum width thereof permits lateral movement of the fulcrum member relative to the pin 42. Because the axis 78 defining the maximum width is disposed generally normally to the fulcrum member bearing surface 56, the opening 76 permits generally lateral movement of the fulcrum member relative to the head bearing surface when the fulcrum member is in the extended position as shown in FIG. 8. The lost motion ensures intimate contact between the bearing surfaces of the fulcrum member and the head, thus relieving load from the hinge pin when extracting nails. Referring to relative positions shown in FIG. 9, which is a partial schematic, it can be seen that the axis 78 extends approximately normally to the contact area between the surfaces 56 and 98, shown as a broken line, and the counter bore is also oval shaped to provide the lost motion. It can be seen that the contact area between the bearing surfaces is disposed between the hinge pin and the outer periphery of the fulcrum member which is in contact with the work surface. This positioning assists in relieving load from the hinge pin when extracting nails.

The direct transfer of the load between the fulcrum member and hammer head contrasts with many of the prior art devices where load from the fulcrum member or equivalent is transferred to the hinge pin which has a tendency to fail when subjected to heavy usage. It can be seen that the bearing area between the surfaces 56 and 98 is relatively large and thus bearing pressures therebetween are likely to be lower than bearing pressure encountered in contact between fulcrum members and the hammer heads of the prior art devices.

OPERATION

To extract the nail 118 from the work surface 119 several options are available. If the head 117 of the nail is fully recessed into the surface 119, the recess 25 of the claw finger 18 is fitted adjacent the head 117, and the striking face 13 is hit with another hammer so as to drive the recess around the nail head. The nail can now be withdrawn partially from the wood by swinging the hammer in the usual manner, and if necessary, the nail can be repositioned within the recess 20 between the claw fingers 17 and 18 for further extraction. When the nail has been withdrawn sufficiently from the surface to approach the initial relative position shown in FIG. 7, the hammer can be positioned so that the surface 119 is in the relative broken outline position 119.1, and the fulcrum 35 can be extended to increase leverage. Initially, the first portion 61 of the outer periphery 54 is in contact with the surface 119.1, and, because of the relatively large curvature of the portion 61, the fulcrum member is supported over a relatively large area and indentation of the wood surface is negligible. As the hammer head rotates in the direction of the arrow 124, the contact with the surface 119. The surface 63 has a smaller radius of curvature, which results in less area of contact between the fulcrum member 35 and the surface 119, but because extraction forces are now reduced, penetration of the fulcrum member into the surface is correspondingly less. As the hammer completes the swing so that the work surface 119 attains the third position 119.2, it can be seen that the third portion 65 of the outer periphery is in contact with the work surface 119. Because the third portion 65 has a radius smaller than the second portion 63, bearing area is less but extraction forces are correspondingly less. The portion 65 is relatively smooth and the surface 119 is not subjected to a sharp corner on the fulcrum member, in contrast with fulcrum members in some of the prior art devices.

It is seen that the outer periphery has a partially cylindrical surface in which, in the extended position, a first portion that is generally adjacent the claw device has a relatively large radius of curvature to spread load onto the work surface when initially extracting the nail. The outer periphery also has second and third portions that are further from the claw device, each having a smaller radius of curvature that contacts the work surface when the nail is partially removed therefrom. The portions are smoothly connected and there is a gradual decrease in radius of curvature to avoid sharp corners. When an operator uses care, a long nail can be pulled from the work surface with negligible bending of the nail, thus contrasting with many pullers of the prior art.

ALTERNATIVES AND EQUIVALENTS

In the structure as described, the hinge pin 42 is secured to the hammer head, and the fulcrum member has the non-circular opening 76 so as to swing about the hinge pin. In an alternative, not shown, the fulcrum member can have a fixed hinge pin and the head could be provided with a non-circular opening. In yet another alternative, not shown, the hinge pin could have an eccentric to mount the fulcrum member thereon to produce the lateral movement of the fulcrum member towards the hammer head to ensure intimate contact between the complementary bearing surfaces. In all such arrangements, a hinge pin journals the fulcrum member for rotation about the hammer head, the pin being rotationally mounted in a hinge bore to permit limited lateral movement of the fulcrum member relative to the head to insure intimate contact between the bearing surfaces as described. In all equivalent structures, the hinge assembly provides load relieving means cooperating with the fulcrum member and the hammer head when the fulcrum member is in the extended position so to relieve load from the hinge assembly when extracting nails.

Also, as seen in FIG. 6, the second face of the hammer head and the main face 86 of the recess 45 are shown to be parallel. If desired, a slight draw angle 114 could be incorporated on the face 86, and also on the corresponding inner face 81 of the fulcrum member. In this alternative, the face 81 would be as shown in 81.1, and the face 86 would be as shown at 86.1. This could result in a better fit between the fulcrum member and the head when in a retracted position.

The fulcrum member is retained in the recess in the retracted position by the resiliently mounted plunger member which is slidable axially in the bore. An alternative retaining means can be used, for example a spring loaded ball mounted in the head of the fulcrum member to engage a complementary recess in the opposite surface. Such a ball could not be easily removed from the recess by the operator as is possible with the plunger member 47. Alternatively, one or more strong permanent magnets could be fitted as required in the head and/or in the fulcrum member to retain the fulcrum member in the retracted position. In all equivalent structures, a retaining means cooperates with the fulcrum member and the hammer head to retain the fulcrum member in the retracted position while hammering and various alternatives are possible.

I claim:

1. A hammer head adapted to be fixed to a hammer shaft, the head having a face at one end for striking a nail for driving the nail into a work surface, and a claw device at an opposite end for extracting the nail from the work surface, the head being characterized by:

(a) a fulcrum member having an inner portion hinged to the head by a hinge assembly for rotation between extended and retracted positions, the hinge assembly having a hinge axis disposed normally to the hammer shaft and normally to a head axis extending between ends of the hammer head, (b) load relieving means characterized by the fulcrum member having a fulcrum member bearing surface and the hammer head having a head bearing surface, the two bearing surfaces being adapted to contact each other when the fulcrum member is in the extended position, so that a contact area between the bearing surfaces is disposed between the hinge pin and an outer periphery of the fulcrum member which is in contact with the work surface, so as to transfer load between the bearing surfaces, and to relieve load from the hinge assembly when extracting nails, (c) the head having a recess to receive the fulcrum member in the retracted position, (d) retaining means cooperating with the fulcrum member and the hammer head to retain the fulcrum member in the retracted position while hammering.

2. A hammer head as claimed in claim 1 further characterized by:

(a) the hinge assembly cooperating with the fulcrum member to permit limited lateral movement of the fulcrum member relative to the head bearing surface to ensure intimate contact between the head and fulcrum member bearing surfaces to relieve load from the hinge assembly.

3. A hammer head as claimed in claim 1 in which:

(a) the fulcrum member has an outer portion disposed at an end of the fulcrum member generally opposite to the inner portion, the outer portion having, in the extended position, the outer periphery to contact the work surface and an inner periphery to contact the hammer head, the contact between the inner periphery and the head relieving load form the hinge assembly when extracting nails to provide the load relieving means.

4. A hammer head as claimed in claim 1 in which:

(a) the fulcrum member has an outer portion which has a width as measured parallel to the hinge axis greater than the width of the inner portion to provide a shoulder between the inner and outer portions, the shoulder having a bearing portion to provide the fulcrum member bearing surface, (b) a portion of the head adjacent the recess providing the head bearing surface which is complementary to the bearing portion of the shoulder when the fulcrum member is in the extended position.

5. A hammer head as claimed in claim 4 in which:

(a) the outer portion of the fulcrum member has the outer periphery having a width which approximates to width of the hammer head as measured parallel to the hinge axis.

6. A hammer head as claimed in claim 4 in which:

(a) the outer periphery has a partially cylindrical surface in which, in the extended position, a first portion that is generally adjacent the claw device has a relatively large radius of curvature to spread load onto the work surface when initially extracting the nail, and a second portion that is further from the claw device has a smaller radius of curvature that contacts the work surface when the nail is partially removed therefrom.

7. A hammer head as claimed in claim 3 in which:

(a) the hinge assembly includes a hinge pin journalling the fulcrum member for rotation relative to the head, the pin being rotationally mounted in a hinge bore to permit limited lateral movement of the fulcrum member relative to the head to ensure intimate contact between the bearing surfaces of the fulcrum member and the head, thus relieving load from the hinge pin to provide the load relieving means.

8. A hammer head as claimed in claim 4 in which:

(a) the fulcrum member has an opening to receive the hinge pin, the opening being non-circular and having a maximum width greater than diameter of the hinge pin, an axis defining the maximum width being disposed generally normally to the fulcrum member bearing surface to permit generally lateral movement of the fulcrum member relative to the head bearing surface when the fulcrum member is in the extended position.

9. A hammer head as claimed in claim 1 in which the retaining means includes:

(a) a plunger member resiliently mounted within a bore of the fulcrum member for movement generally parallel to the hinge axis, the plunger having an inner portion projecting inwardly from an inner face of the fulcrum member, (b) the recess of the head having a main face adapted to be adjacent the inner face of the fulcrum member when the fulcrum member is in the retracted position, the main face having a plunger recess to receive the inner portion of the plunger member so as to hold the fulcrum member in the retracted position.

10. A hammer head as claimed in claim 9 in which:

(a) the plunger member has an outer portion adjacent a face of the fulcrum member remote from the inner face, the outer portion being adapted to be gripped by an operator to move the plunger member axially outwardly from the fulcrum member so as to withdraw the inner end of the plunger member from the plunger recess to permit the fulcrum member to attain the extended position.

11. A hammer head as claimed in claim 1 in which the claw device is further characterized by:

(a) a first pair of spaced claw fingers having a pair of oppositely disposed, inwardly facing edges which define a first tapered recess therebetween, (b) one of the claw fingers having an outer end having a second pair of claw fingers which define a second tapered recess therebetween, the fingers of the second pair being thinner than the fingers of the first pair.

12. A hammer head as claimed in claim 11 in which the claw device is further characterized by:

(a) the claw finger of the first pair having the second tapered recess extending further from the shaft than the remaining claw finger without the recess, so as to ensure that the remaining finger of the first pair does not interfere with the work surface during extraction of the nail.

13. A hammer head as claimed in claim 12 in which:

(a) the oppositely disposed, inwardly facing edges of the second recess are bevelled to facilitate positioning of the claw fingers of the second pair under the head of the nail.

14. A hammer having a head and a hammer shaft, the head having a face at one end for striking a nail for driving the nail into a work surface, and a claw device at an opposite end for extracting the nail from the work surface, the head being characterized by:

(a) a fulcrum having an inner portion hinged to the head by a hinge assembly for rotation between extended and retracted positions, the hinge assembly having a hinge axis disposed normally to the hammer shaft and normally to a head axis extending between ends of the hammer head, (b) load relieving means characterized by the fulcrum member having a fulcrum member bearing surface and the hammer head having a head bearing surface, the two bearing surfaces being adapted to contact each other when the fulcrum member is in the extended position, so that a contact area between the bearing surfaces is disposed between the hinge pin and an outer periphery of the fulcrum member which is in contact with the work surface, so as to transfer load between the bearing surfaces, and to relieve load from the hinge assembly when extracting nails, (c) the head having a recess to receive the fulcrum member in the retracted position, (d) retaining means cooperating with the fulcrum member and the hammer head to retain the fulcrum member in the retracted position while hammering.

15. A hammer as claimed in claim 14 further characterized by:

(a) the hinge assembly cooperating with the fulcrum member to permit limited lateral movement of the fulcrum member relative to the head bearing surface to ensure intimate contact between the head and fulcrum member bearing surfaces to relieve load from the hinge assembly.

* * * * *